US005207388A

United States Patent [19]

Leroux et al.

[11] Patent Number: 5,207,388

[45] Date of Patent: May 4, 1993

[54] INNER PROFILE NOZZLE ADAPTED FOR THE HIGH TEMPERATURE TESTING OF SPECIMENS OR SIMILAR OF THE "PLANE BOARD" TYPE

[75] Inventors: René G. G. M. Leroux, Merignac; Gilles P. Taquin, Orgeval, both of France

[73] Assignee: Aerospatiale Societe Nationale Industrielle, Paris, France

[21] Appl. No.: 886,394

[22] Filed: May 21, 1992

[30] Foreign Application Priority Data

May 23, 1991 [FR] France ..... 91 06423

[51] Int. Cl.[5] ..... B05B 1/00

[52] U.S. Cl. ..... 239/598

[58] Field of Search ..... 239/597-599, 239/601, 589; 60/271

[56] References Cited

U.S. PATENT DOCUMENTS

| | | | |
|---|---|---|---|
| 2,583,726 | 1/1952 | Chalom | 239/601 |
| 3,130,920 | 4/1964 | Devillard | 239/601 |
| 3,189,321 | 6/1965 | Devillard et al. | 239/598 |
| 3,239,130 | 3/1966 | Naundorf . | |
| 3,747,859 | 7/1973 | Gabel et al. | 239/601 X |
| 4,066,491 | 1/1972 | Ruh et al. | 239/601 X |
| 4,300,723 | 11/1981 | Rasthofer | 239/601 X |
| 4,548,033 | 10/1985 | Cann . | |
| 4,577,461 | 3/1986 | Cann . | |

FOREIGN PATENT DOCUMENTS

| | | | |
|---|---|---|---|
| 1156742 | 5/1958 | France | 239/601 |
| 2177939 | 7/1985 | United Kingdom | 239/601 |

OTHER PUBLICATIONS

Marcum et al., Journal of American Institute of Aeronautics and Astronautics, vol. 23, No. 10, Oct. 1985, New York, U.S., pp. 1497-1505, Abstract of article.

Fenain et al., Recherche Aerospatiale, No. 5, Oct. 9, 1974, France, pp. 261-276.

Rizk et al., Applied Mathematical Modelling, vol. 7, No. 2, Apr. 1983, United Kingdom, pp. 123-127.

T. Larson, 1969 European Microwave Conference, 1970, IEE, London, United Kingdom, pp. 277-280.

French Search Report and Annex.

*Primary Examiner*—Andres Kashnikow
*Assistant Examiner*—Kevin Weldon
*Attorney, Agent, or Firm*—Sandler Greenblum & Bernstein

[57] ABSTRACT

Inner profile nozzle adapted for high temperature testing of specimens of the "plane board" type includes an axisymmetric convergent, a throat region, a divergent super-elliptic lying on two rectilinear generating lines taken along two perpendicular planes, including a small axis generating line having a slope of about 1°, and a long axis generating line having a slope of about 10°. The throat region is provided with corresponding circular generating lines having downstream ends coupled with the small axis and the long axis generating lines by a curve obtained from an equation whose first and second derivatives are continuous, and whose third derivative is monotonic, so as to eliminate or reduce recompression problems and possible formation of shocks. This nozzle is particularly applicable to the high temperature testing of space vehicle materials.

20 Claims, 6 Drawing Sheets

INNER PROFILE NOZZLE ADAPTED FOR THE HIGH TEMPERATURE TESTING OF SPECIMENS OR SIMILAR OF THE "PLANE BOARD" TYPE

BACKGROUND OF THE INVENTION

1. Field of the Invention

The present invention relates to a so-called "high temperature" nozzle and particularly to a plasma nozzle whose inner profile is specifically designed to allow the plane board type testing of specimens, particularly of materials that must withstand high thermal and pressure stresses.

The invention particularly concerns the testing of materials intended to form the hot parts of space missiles bound to meet heavy conditions of atmospheric reentry that result in high temperatures (from 110020 to 1900° C.) and low pressures for a comparatively long time (about half an hour).

2. Discussion of Background Information

The so-called "plane board" type of tests consists in placing a specimen made up of a monolithic block or of several elements of one or several materials to be tested, parallel to a nozzle jet, and in measuring the static pressure as well as the temperature at various points of the surface of the specimen or of the assembly of materials for surface incidences in relation to the nozzle jet ranging from 0 to a few degrees.

Such tests are carried by means of an arrangement comprising a plasma generator that produces a high temperature flow, a nozzle placed downstream from the generator and transforming the flow so as to adjust it to the required testing conditions, a testing chamber into which the nozzle opens and wherein the arrangements for displaying the specimens or similar are installed as well as the various measuring means necessary for testing, a diffuser located downstream from the chamber and meant to collect the flow after it has run onto the specimens, a heat exchanger so as to cool the flow, and a vacuum system placed downstream intended to maintain, inside the chamber, the low pressure level required for that type of tests.

The specific shape of the specimens for "plane board" testing requires a nozzle with an appropriate design consisting of a rectilinear edge on the downstream end liable to be connected to one of the rectilinear edges of the specimen.

Two types of nozzle are currently used for "plane board" testing, namely a so-called "square tube" nozzle and a "semicircular" nozzle.

The "square tube" nozzle comprises a divergent whose section, at the outlet, is slightly rectangular with round-off angles, whereas the "semicircular" nozzle is an axisymmetric nozzle whose divergent is reduced to half according to a plane comprising the axis of the nozzle.

The tests that are carried out with those types of nozzle are not fully satisfactory since the nozzles generate a very disturbed whirling stream, at the outlet, the stream being incompatible with the very homogeneous hot gas flow required during "plane board" testing, so as to obtain a distribution of the static pressures and of the thermal flows as uniform as possible on the exposed surface of the specimen.

SUMMARY OF THE INVENTION

The object of the present invention is to provide a supersonic nozzle designed for the "plane board" type testing, namely a nozzle having a flat-shaped outlet and being able to provide such a flow that the pressure profile be as uniform as possible at least at the flat part.

It is therefor an object of the invention to provide a nozzle with an inner profile adapted for the high temperature testing of specimens or similar of the "plane board" type, characterized in that it comprises an axisymmetric convergent and an axisymmetric throat region on the one hand, and of a divergent having a super-elliptic section lying on two rectilinear generating lines taken along two perpendicular planes, with one of the generating lines being a so-called small axis generating line having a slope of the order of 1° and the other being a so-called long axis generating line having a slope of the order of 10°, the downstream ends of the corresponding circular generating lines of the throat region being coupled with the small axis and long axis generating lines by a curve whose equation is such as the first and second derivatives are continuous, and the third derivative is monotonic, so as to eliminate or reduce recompression problems and the possible formation of shocks.

Advantageously, the super-elliptic section is a curve obtained from the following equation:

$$[Y/R_1(X)]^2+[Z/R_2(X)]^{N(X)}=1$$

wherein:

$R_1(X)$ and $R_2(X)$ are the radial distances at the abscissa X of the small axis and long axis generating lines respectively;

Y and Z are the coordinates of a point of the divergent;

N(X) is the super-elliptic exponent, such exponent having a variation curve increasing from the value 2 to a higher value that enables to obtain the desired flatness at the nozzle outlet.

The super-elliptic exponent selected thereby ensures the desired flatness at the nozzle outlet, and the correct junction between the divergent and the throat region on the other hand.

In order to improve the junction between the divergent and the throat region and to make sure that the transition from the axisymmetric geometry of the throat to the super-elliptic geometry of the divergent occurs with the highest monotonicity, particularly in the area of the long axis generating line, the latter is shifted of a value $\epsilon$ and the curve connecting the upstream ends of the generating line before shifting ($E_0$) and after shifting ($E_1$) respectively, is determined by means of a polynomial of degree 4 of the following type:

$$F(X)=A(X-X_1)^4+B(X-X_1)^3+aX+b-\epsilon$$

wherein:

A and B are constants and $aX+b-\epsilon$ is the equation of the long axis generating line after shifting, the origin of the abscissae being computed from the throat, the value $X_0$, the abscissa of the upstream end of said generating line before shifting being chosen and the values $\epsilon$, X and $X_1$, the abscissa of the upstream end of said generating line after shifting, being calculated by means of the above-mentioned polynomial in order to ensure the continuity of the first and second derivatives at point $E_0$ as well as the strict monotony of the third derivative between $E_0$ and $E_1$.

In order that the transition from the axisymmetric geometry of the throat to the super-elliptic geometry of the divergent might take place with the highest monotonicity, it is important that the variation curve of the super-elliptic exponent N(X) show continuity properties of its first and second derivatives at the level of the junction to the axisymmetric surface of the throat, and that the first and second derivatives be nil, particularly at the junction point $E_0$.

Finally, it is preferable for the property of the evolution curve of N(X) to be also present at the nozzle outlet and if, as a general rule, the variation curve has approximately nil first and second derivatives at the two extreme values of the exponent, while being monotonic ascending and having an intermediary inflection point.

The invention thereby allows to realize a nozzle whose outlet has two approximately rectilinear parallel edges having their ends coupled by two approximately semi-elliptic curves, and wherein the outflow is perfectly homogeneous, such homogeneity being characterized by a low pressure variation, of the order of 1%, along the plane part.

BRIEF DESCRIPTION OF THE DRAWINGS

These and other characteristics and advantages of the invention will be more fully set forth in the following description of an embodiment of a nozzle in accordance with the invention, a description given as an example only and considered in connection with the accompanying drawings, wherein.

DETAILED DESCRIPTION OF THE PREFERRED EMBODIMENTS

FIGS. 1 to 4 Illustrate an embodiment of a nozzle according to the invention comprising a cone-shaped convergent 1, a throat 2 of circular section and a divergent 3 that is very much elongated in relation to the length of the convergent 1.

The divergent shows a super-elliptic section lying on two rectilinear generating lines taken in two perpendicular planes containing the axis X'X of the nozzle and forming, for the latter, the two planes of symmetry.

Figure 4:
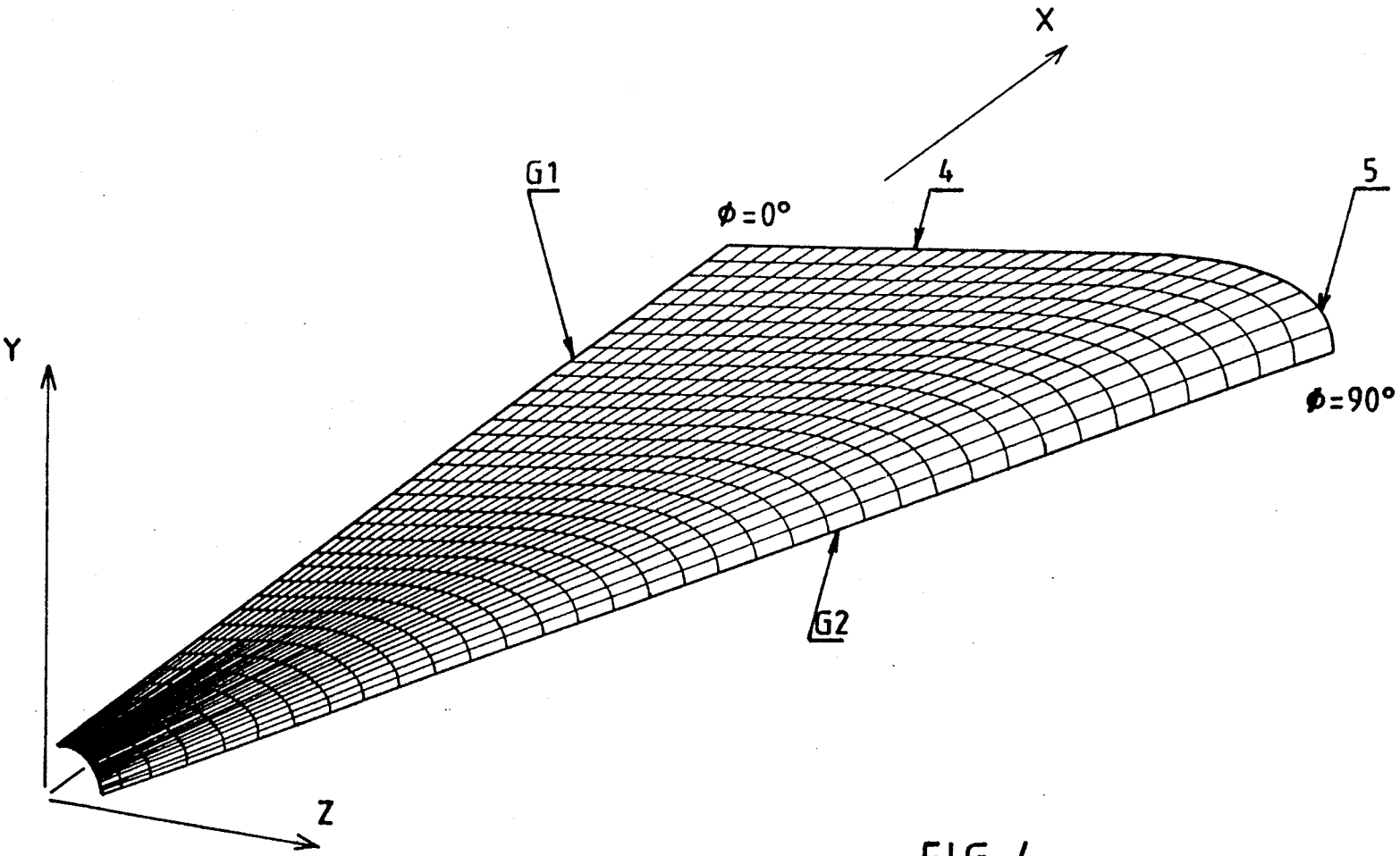
FIG. 4 is a perspective view of a quarter of the divergent.

One of the generating lines, G1, the small axis one, is in a plane called $\phi=0°$ defining the reference plane XY of FIG. 4, whereas the other generating line G2, the long axis one, is in the plane called $\phi=90°$ defining the reference plane XZ of the FIG. 4.

Figure 1:
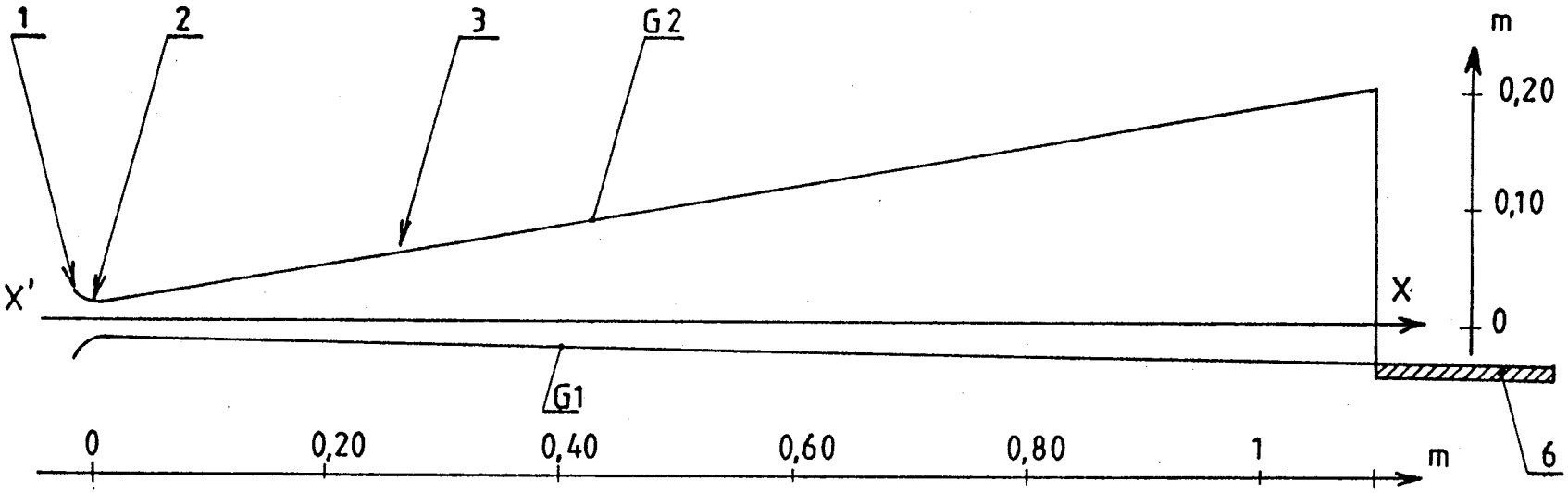
FIG. 1 is a schematic axial section according to a small axis generating line (lower half-section) and a long axis generating line (upper half-section) of a nozzle in accordance with the invention.
Figure 2:
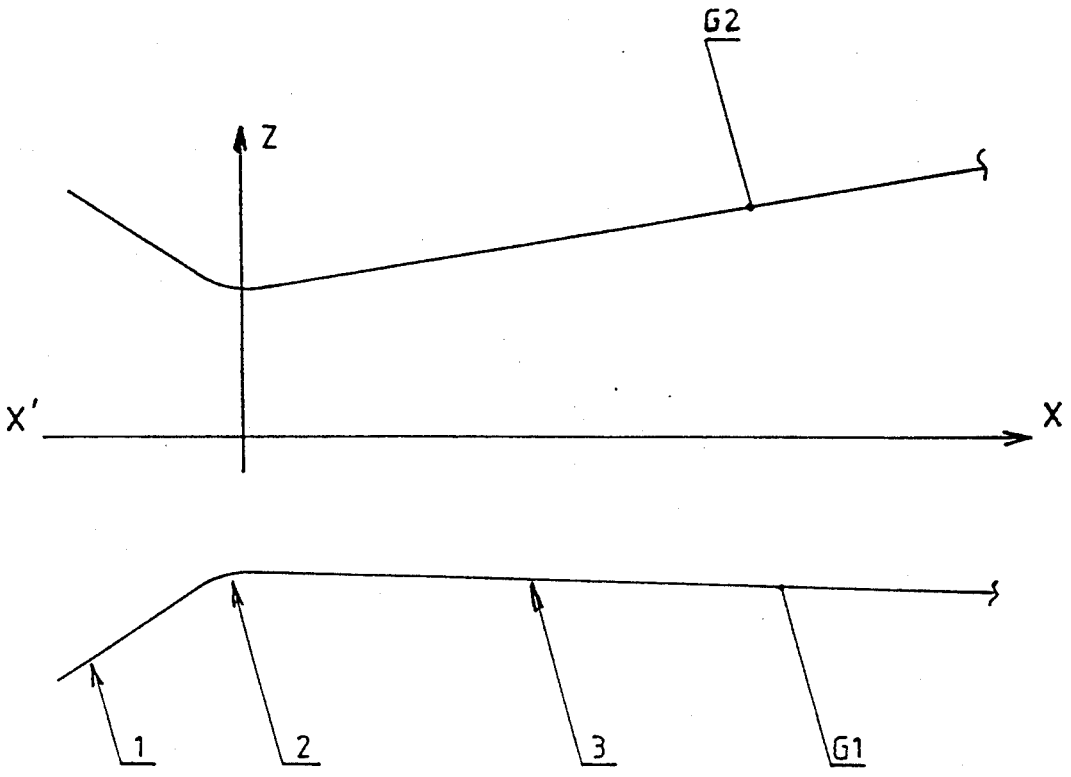
FIG. 2 is an enlarged view of the convergent, the throat region and the divergent initial part of the nozzle of FIG. 1.
Figure 3:
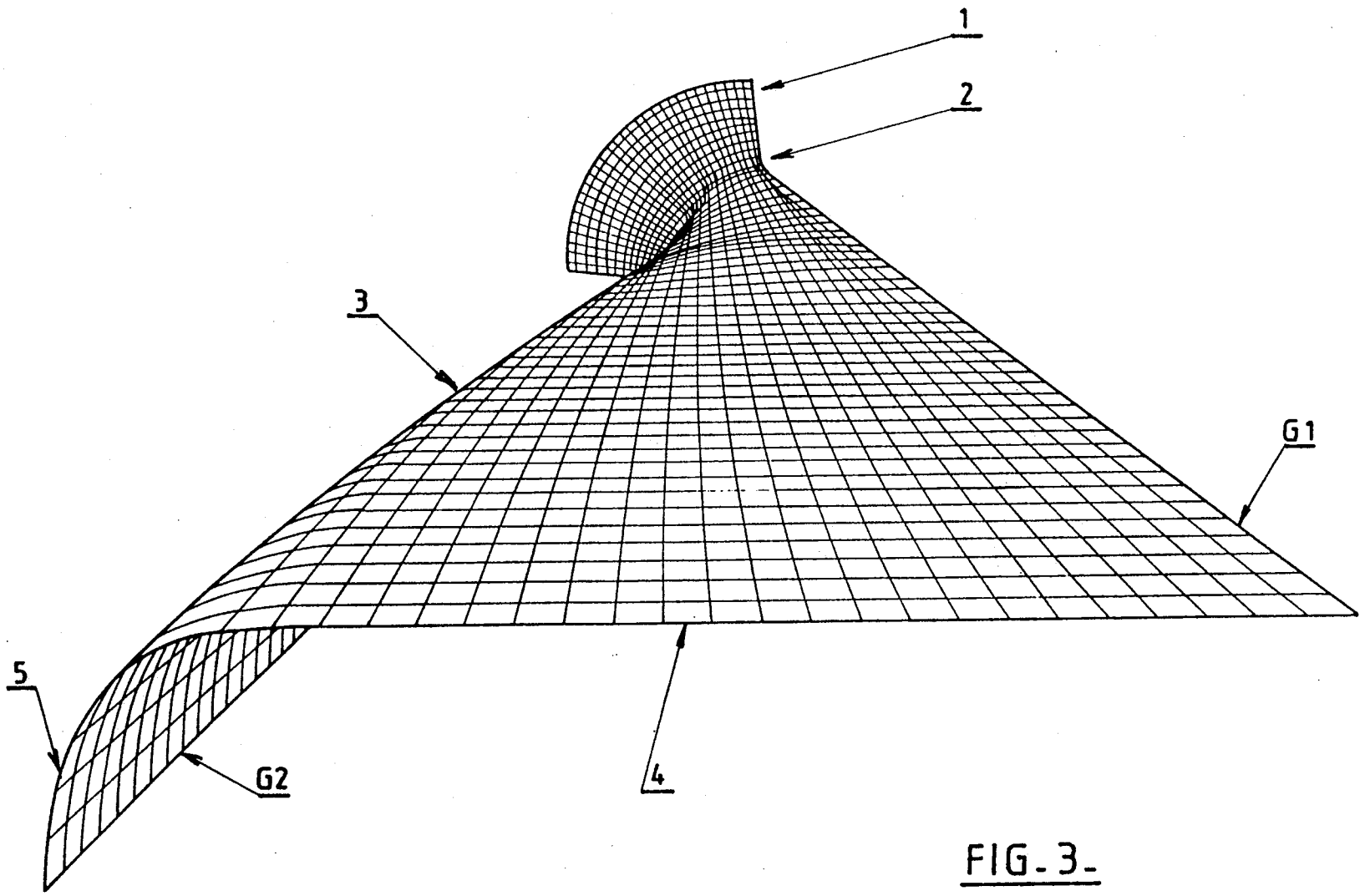
FIG. 3 is a perspective partial view from above of a quarter of the nozzle, on the outlet side.

FIGS. 3 and 4 are partial views of the nozzle of FIGS. 1 and 2 in the form of meshing.

The generating line G1 shows a slope of about 1° in relation to the axis X'X, whereas the generating line G2 shows a slope of about 10° in relation to the axis X'X.

The outlet section of the nozzle, a quarter of which can be seen in FIG. 3, is delimited by two approximately rectilinear and parallel edges (one only being partly represented at 4 in FIGS. 3 and 4) being coupled with the ends by means of approximately elliptic curves shown at 5 in FIGS. 3 and 4. For example, the length of both approximately rectilinear edges is included between 0.30 and 0.40 m and the small axis of the outlet section has a length included between 0.05 and 0.08 m.

The nozzle is intended for testing heat flows on plane plates, one of which is schematically represented at 6 in FIG. 1.

The plane plates consist of specimens of materials to be tested, or of an assembly of materials, whose upper surface is layed in prolongation of the rectilinear lower edge of the nozzle outlet, means being provided so as to give a slight angle to the exposed surface of the plane plate 6 by raising the latter around the edge bordering the nozzle outlet.

The testing plane plates are usually 30 cm. wide, therefore the rectilinear edge at the outlet 4 of the nozzle should be at least 30 cm. long.

In accordance with the invention, the divergent 3 has been designed so as to pass constantly from a circular axisymmetric geometry at the level of the throat 2, to a super-elliptic geometry at the nozzle outlet in order to obtain an approximately rectilinear outlet edge, which is long enough and having a pressure profile as uniform as possible.

It has been noted that a remarkably uniform pressure profile could be obtained when taking, as a super-elliptic type curve of any section of the divergent 3, a curve which satisfies the equation:

$$[Y/R_1(X)]^2+[Z/R_2(X)]^{N(X)}=1$$

wherein:

$R_1(X)$ and $R_2(X)$ are radial distances of said generating lines G1 and G2 at the abscissa X taken from the throat 2;

Y and Z are the coordinates of one point of the divergent section at the abscissa X;

N(X) is the super-elliptic exponent.

At the throat 2, the abscissa X is nil and $R_1(X)=R_2(X)=$radius of the throat 2, assigning the value 2 to N(X).

Then by making N(X) move ascendingly toward a higher value, 10 for example, forcing it to follow a variation curve having a curvature such that it has first and second derivatives which are approximately nil at the two extreme values of the exponent, while being monotonic ascending and having an intermediary reversal point, one can obtain a nozzle section that constantly gets out of shape so as to get a profile of the above-mentioned type and represented in FIG. 3, at the outlet.

Figure 5:
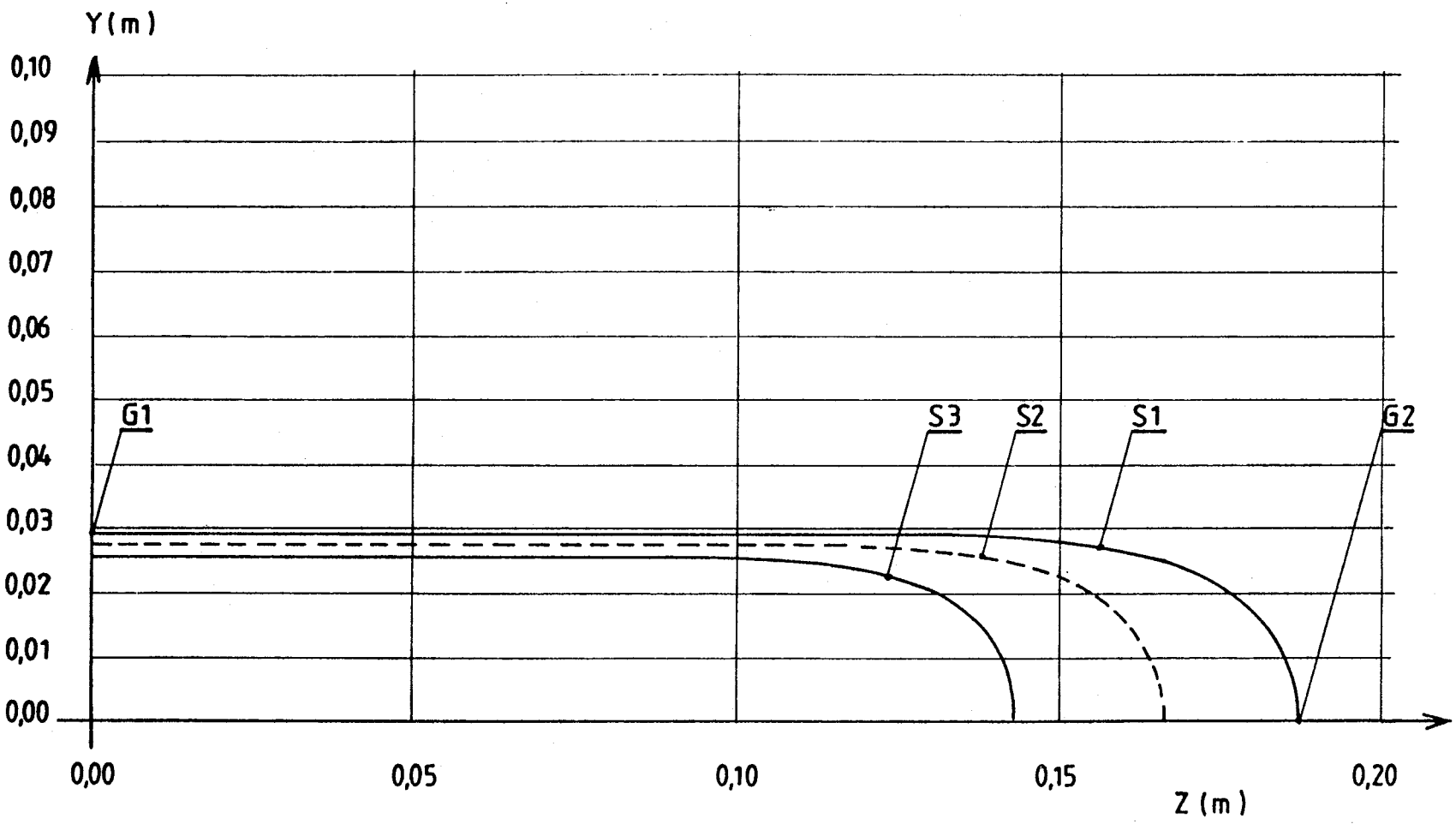
FIG. 5 represents three radial sections of one quarter of the divergent of FIG. 4 in the vicinity of the outlet.

FIG. 5 shows three sections of the nozzle at three different abscissae of the divergent.

Sections S1, S2 and S3 correspond to a section S1/section of the throat 2 ratio equal to 30, 25 and 20 respectively.

There is accordingly obtained, at the outlet of the nozzle, an approximately rectilinear part 4. Such part is not absolutely rectilinear since the outlet section is of a super-elliptic type, but it is possible to obtain a greatest flatness by increasing the value of the super-elliptic exponent N(X).

In practice, it is possible to make N(X) move between values 2 and 20, while respecting the evolution curve, so as to obtain a flatness which is compatible with the testing conditions required for a plasma nozzle.

Furthermore, in order to avoid recompression problems and the possible formation of shocks immediately downstream of the throat 2, it is necessary to make sure that the transition from the axisymmetric geometry of the throat 2 to the super-elliptic geometry of the divergent 3 occurs with the highest monotonicity. Particularly in the plane $\phi=90°$, the transition between the circular generating line of the throat 2 and the generating line G2 inclined at approximately 10° goes with a discontinuity of the second derivatives that could cause possible recompresssions.

So as to avoid such inconvenience and in accordance with the invention, it is to be considered a new generating line G'2 that is shifted from the previous one by a value $\epsilon$, and it is to be looked for a curve F(X) that will allow the connection of the circular generating line of the throat to the new generating line G'2, while maintaining the continuity of the first and second derivatives as well as the monotonicity of the third derivative.

Figure 7:
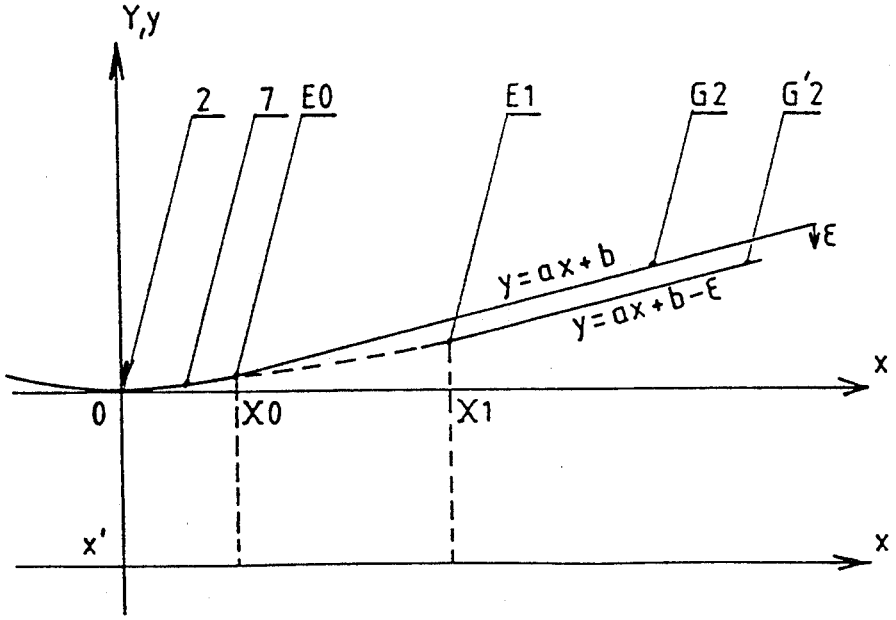
FIG. 7 is a diagram showing the junction between the throat region of the nozzle and the divergent.

It is shown at 7 in FIG. 7 a circular generating line of the throat 2 tangentially coupled with a straight line $y=aX+b$ at point $E_0$. The straight line is shifted toward the axis X'X by a distance $\epsilon$ and translated from the zero point $E_0$ having an abscissa $X_0$ to the zero point $E_1$ having an abscissa $X_1$, so that the junction curve between the point $E_0$ of the straight line G2 and the zero point $E_1$ of the straight line G'2 satisfies the equation:

$$F(X)=A(X-X_1)^4+B(X-X_1)^3+aX+b-\epsilon$$

In that equation, A and B are constants. The abscissa $X_0$ being determined by the tangential point between the long axis generating line, before shifting, and the corresponding circular generating line of the throat, the values $\epsilon$, X and $X_1$ are calculated by means of the above-mentioned equation so as to ensure the continuity of the first and second derivatives at point $E_0$. as well as the strict monotony of the third derivative between points $E_0$ and $E_1$.

It is therefore preferable to take the straight line G'2 as long axis generating line rather than the straight line G2. However, it is not necessary to carry out a similar shifting on the small axis generating line G1, taking into account the very gentle slope in relation to the axis X'X (lower or equal to 1°) that makes the recompression risks very unlikely.

Moreover, it is also important, so as to ensure the highest monotonic transition from the axisymmetric geometry of the throat to the super-elliptic geometry of the divergent, that the variation curve of the super-elliptic exponent N(X) offer continuity properties of the first and second derivatives at the level of the junction with the axisymmetric surface of the throat and that, particularly at the junction point $E_0$, the first and second derivatives be nil.

Finally, it is preferable that the continuity property of the evolution curve of N(X) be also found at the nozzle outlet and that, generally speaking, the variation curve show nil first and second derivatives at the two extreme values of the exponent, while being monotonic ascending and having an intermediary inflection point.

A polynomial of degree 5 could thereby be taken as the variation curve of N(X), insofar as the various above-mentioned conditions would be satisfied.

Obviously, many other functions of the same type or other types meeting the required conditions could also be appropriate as long as they maintain the necessary continuity properties of the first and second derivatives of the functions at the level of the junction ($E_0$) between the divergent 3 and the axisymmetric surface of the throat 2, as well as at the nozzle outlet.

It will be noted that the junction zone between points $E_0$ and $E_1$ is very small in relation to the total length of the divergent since it is of the order of one centimeter, and that, in the junction zone, the super-elliptic section of the nozzle also satisfies the same equation as in the downstream section of the divergent, such equation being mentioned thereinbefore.

Given the above-mentioned indications, there have been realized nozzles having a remarkably homogeneous flow at their outlet section, the relative differences in pressure on the plane part 4 staying below 1.5%.

Several simulation calculations have been made and have enabled to check the very high homogeneity of the flow.

A first set of calculations has been made with a code of non-viscous flow allowing the calculation of the throat at chemical and vibratory equilibrium, and of the divergent, either at equilibrium, at unbalance or at steady state. The results show that the flow rapidly freezes after the throat for all the testing conditions.

Three-dimensional calculations have been made with the viscous flow code in the case of an ideal gas ($\gamma=1.4$). The concordance with the monodimensional calculations is excellent. The flow is very homogeneous in the outlet section, the relative differences in pressure on the plane part staying below 1.5%.

Three-dimensional calculations made for viscous flows with an ideal gas ($\gamma=1.2$) simulation of a real gas at equilibrium, lead to the same conclusions, namely, a flow that is little disturbed and homogeneous in the outlet section ($\Delta P/P=1\%$ along the plane part).

The viscous calculations have been completed by imposing an initial vortex simulating the one generated by the working or the plasma generator at the inlet of the convergent. The vortex effect is cancelled by the acceleration of the longitudinal speed, and the flow is again very homogeneous in the outlet plane ($\Delta P/P=1\%$ along the plane part).

Calculations of turbulent boundary layers have perfected and corroborated the previous results. Such calculations have been carried out for various flow assumptions, either at equilibrium ($\gamma=1.2$), or steady ($\gamma=1.4$), and for plane board and axisymmetric designs.

A comparison with the assumption of a plane board laminar boundary layer at equilibrium enables to confirm the existence of a boundary layer whose thickness depends on the abscissa X that thus decreases the passing through section of the fluid in the nozzle, it follows therefrom that the pressure and temperature levels increase in the non-viscous core.

If the boundary layer turns out to be too thick at the nozzle outlet, taking into account the testing specifications of the specimens, it could be worthwile to reduce the length of the divergent while increasing the ratio between the outlet section of the nozzle and the throat section, such ratio being included between 25 and 45 for example, increasing the slope of the generating line G1 that can be between 0.75° and 1.3° as well as the slope of the generating line G'2 that remains, however, lower or equal to 10°, between 6° and 10° for example.

Considering the testing conditions of specimens 6, namely a static pressure included between 7.5 mb and 22 mb and a thermal flow included between 100 $Kw/m^2$ and 350 $Kw/m^2$ at a wall temperature of 1200° K. and the generating conditions concerning the plasma, namely a reduced enthalpy (Hi/RTo) included between 50 and 135 and a pressure Pi included between 1*b* and 14*b*, it has been designed a nozzle having a 0.9 m long divergent measured from the throat, with, at the outlet, a small axis of 0.07 m and a long axis of about 0.35 m, with a small axis generating line G1 having a slope of 1.3°, a long axis generating line G'2 having a slope of 7.735°, with an outlet section/throat section ratio equal to 33.9 for a throat section of 7 $cm^2$.

Figure 6:
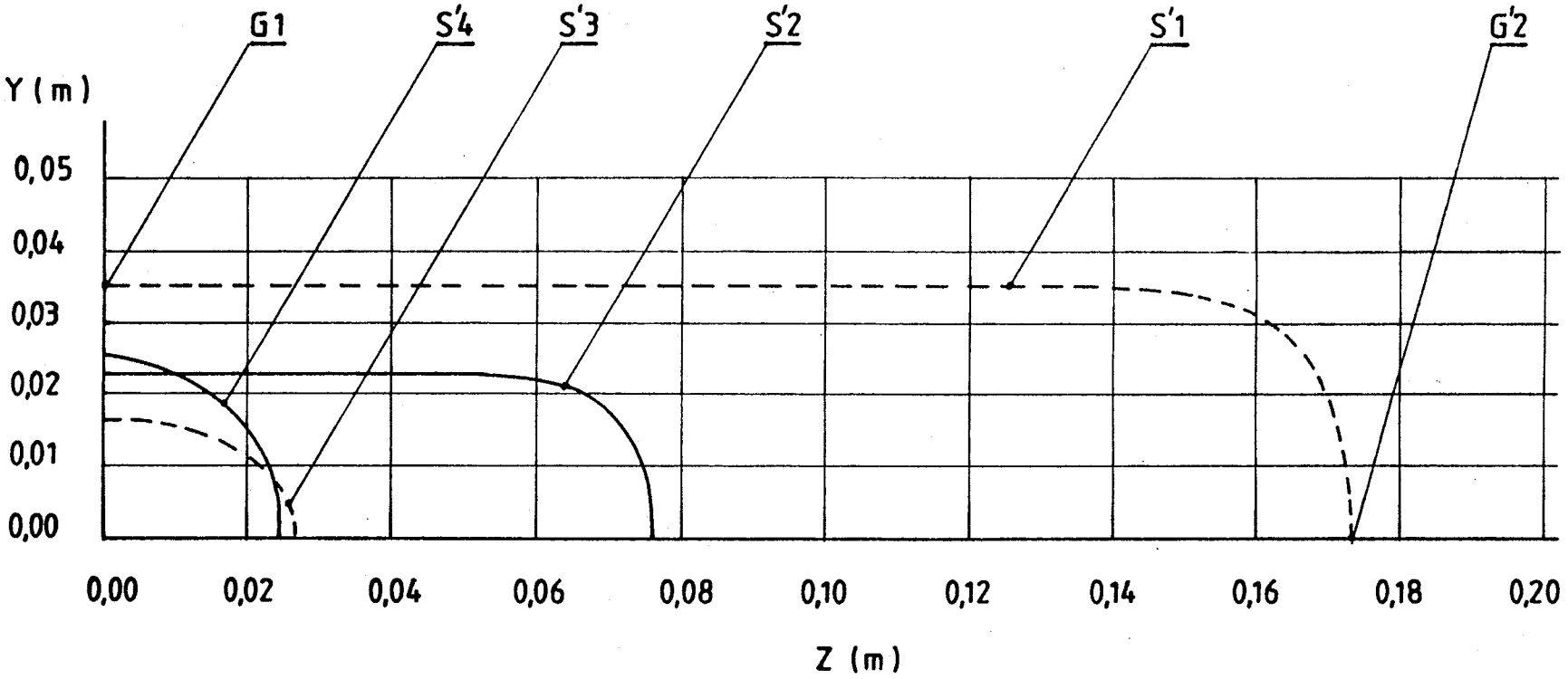
FIG. 6 shows four radial sections of one quarter of another nozzle in conformity with the invention.

FIG. 6 shows (a quarter section) the outlet S'1 of the nozzle thereof, the section of the divergent that corresponds to a ratio of 9.45 in relation to the section of the throat at S'2 a section with a ratio 2 at S'3 and a circular section with a ratio 2.8 realized in the convergent part of the nozzle at S'4. Sections S'1 to S'4 are taken with abscissae along the axis X'X of the nozzle of 0.90 m, 0.35 m, 0.07 m and −0.02 m respectively.

The length of he divergent is not a critical value and depends on the dimensions of the testing chambers and of the specimens; on the other hand, the values defining the slopes of the small axis and long axis generating lines, as well as the outlet section/throat section ratio are characteristic and determining values of the nozzle according to the invention, as well as the equations that determine the super-elliptic sections of the divergent, and also in the zone connecting the axisymmetric region of the throat.

Tests carried out with that type of nozzle for various couples of generating conditions (Pi and Hi/RTo) correspond to the imposed testing specifications as regard the pressure levels obtained at the outlet of the nozzle, and give a satisfying level as regard the heat flows on the wall.

Finally, the invention is obviously not limited to the embodiments represented and described herein, but covers all the possible variations particularly concerning the dimensional parameters determining the divergent, and more specifically the small and long axis generating lines, the length of the divergent and the outlet section/throat section ratio, said parameters varying according to the testing specifications without departing from the scope of the invention.

What is claimed is:

1. An inner profile nozzle adapted for high temperature testing of specimens of the "plane board" type, comprising:

(a) an axisymmetric convergent;

(b) a throat region;

(c) a divergent super-elliptic lying on two rectilinear generating lines taken along two perpendicular planes, one of said two rectilinear generating lines comprising a small axis generating line having a slope of about 1°, and the other of said two rectilinear generating lines comprising a long axis generating line having a slope of about 10°; and (d) said throat region comprising corresponding circular generating lines having downstream ends coupled with said small axis generating line and said long axis generating line by a curve obtained from an equation whose first and second derivatives are continuous, and whose third derivative is monotonic, so as to eliminate or reduce recompression problems and possible formation of shocks.

2. The nozzle according to claim 1, wherein said super-elliptic section comprises a curve obtained from the following equation:

$$[Y/R_1(X)^2]+[Z/R_2(X)]^{N(X)}=1$$

wherein:

$R_1(X)$ and $R_2(X)$ are radial distances at abscissa X of said small axis generating line and said long axis generating line, respectively;

Y and Z are the coordinates of a point of said super-elliptic divergent; and

N(X) is a super-elliptic exponent having a variation curve with a shape that increasingly evolves from a value of 2, to thereby obtain desired flatness at the nozzle outlet.

3. The nozzle according to claim 1, wherein at least said long axis generating line is shifted by a value $\epsilon$, and the curve connecting upstream ends of said at least said long axis generating line prior to shifting ($E_0$) and after shifting ($E_1$), respectively, is determined by a polynomial of degree 4, as follows:

$$F(X)=A(X-X_1)^4+B(X-X_1)^3+aX+b-\epsilon$$

wherein:

A and B are constants, and $aX+B-\epsilon$ is the equation of the long axis generating line after shifting, the origin of the abscissa being computed from the throat region, with the value $X_0$, which is the abscissa of an upstream end of said at least said long axis generating line prior to shifting, being selected, and the values $\epsilon$, X and $X_1$, which are the abscissa of the upstream end of said at least said long axis generating line after shifting, being calculated by the polynomial, so as to ensure the continuity of the first and second derivatives at point $E_0$ as well as strict monotony of the third derivative between $E_0$ and $E_1$.

4. The nozzle according to claim 2, wherein at least said long axis generating line is shifted by a value $\epsilon$, and the curve connecting upstream ends of said at least said long axis generating line prior to shifting ($E_0$) and after shifting ($E_1$), respectively, is determined by a polynomial of degree 4 as follows:

$$F(X)=A(X-X_1)^4+B(X-X_1)^3+aX+b-\epsilon$$

wherein:

A and B are constants, and $aX+B-\epsilon$ is the equation of the long axis generating line after shifting, the origin of the abscissa being computed from the throat region, with the value $X_0$, which is the abscissa of an upstream end of said at least said long axis generating line prior to shifting, being selected, and the values $\epsilon$, X and $X_1$, which are the abscissa of the upstream end of said at least said long axis generating line after shifting, being calculated by the polynomial, so as to ensure the continuity of the first and second derivatives at point $E_0$ as well as strict monotony of the third derivative between $E_0$ and $E_1$.

5. The nozzle according to claim 2, wherein the variation curve of the super-elliptic exponent N(X) has first and second derivatives that are substantially nil at two extreme values of the super-elliptic exponent, and is monotonic ascending and has an intermediary inflection point.

6. The nozzle according to claim 4, wherein the variation curve of the super-elliptic exponent N(X) has first and second derivatives that are substantially nil at two extreme values of the super-elliptic exponent, and is monotonic ascending and has an intermediary inflection point.

7. The nozzle according to claim 2, wherein the variation curve of the super-elliptic exponent N(X) is a polynomial of degree 5.

8. The nozzle according to claim 4, wherein the variation curve of the super-elliptic exponent N(X) is a polynomial of degree 5.

9. The nozzle according to claim 2, wherein said super-elliptic exponent varies from a value of 2 to 20.

10. The nozzle according to claim 4, wherein said super-elliptic exponent varies from a value of 2 to 20.

11. The nozzle according to claim 5, wherein said super-elliptic exponent varies from a value of 2 to 20.

12. The nozzle according to claim 6, wherein said super-elliptic exponent varies from a value of 2 to 20.

13. The nozzle according to claim 8, wherein said super-elliptic exponent varies from a value of 2 to 20.

14. The nozzle according to claim 1, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generating line of the outlet section having a length of about 0.05 to 0.08 m.

15. The nozzle according to claim 2, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generating line of the outlet section having a length of about 0.05 to 0.08 m.

16. The nozzle according to claim 3, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generating line of the outlet section having a length of about 0.05 to 0.08 m.

17. The nozzle according to claim 4, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generating line of the outlet section having a length of about 0.05 to 0.08 m.

18. The nozzle according to claim 5, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generating line of the outlet section having a length of about 0.05 to 0.08 m.

19. The nozzle according to claim 6, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generating line of the outlet section having a length of about 0.05 to 0.08 m.

20. The nozzle according to claim 7, wherein:

said super-elliptic divergent lies on a small axis generating line having a slope of about 0.75° to 1.3°, and a long axis generating line having a slope of about 6° to 10°;

a ratio of an outlet section of the super-elliptic divergent and said throat region being about 25 to 45; and said outlet section comprises two parts that are substantially rectilinear and have a length of about 0.30 to 0.40 m connected by substantially semi-elliptical curves, and the small axis generally line of the outlet section having a length of about 0.05 to 0.08 m.

* * * * *